US007256539B2

(12) United States Patent
Yu

(10) Patent No.: US 7,256,539 B2
(45) Date of Patent: Aug. 14, 2007

(54) ECCENTRIC PLANAR FLUORESCENT TUBE

(76) Inventor: William Yu, 25121 Vista Ridge Rd., Laytonsville, MD (US) 20882

( * ) Notice: Subject to any disclaimer, the term of this patent is extended or adjusted under 35 U.S.C. 154(b) by 0 days.

(21) Appl. No.: 10/500,850

(22) PCT Filed: Jan. 7, 2003

(86) PCT No.: PCT/CN03/00008

§ 371 (c)(1),
(2), (4) Date: Feb. 16, 2005

(87) PCT Pub. No.: WO03/058675

PCT Pub. Date: Jul. 17, 2003

(65) Prior Publication Data

US 2005/0140266 A1 Jun. 30, 2005

(30) Foreign Application Priority Data

Jul. 1, 2002 (CN) ..... 02 2 15016

(51) Int. Cl.

| | |
|---|---|
| ***H01J 63/04*** | (2006.01) |
| ***H01J 5/48*** | (2006.01) |
| ***H01J 5/50*** | (2006.01) |
| ***H01J 5/54*** | (2006.01) |
| ***F21V 7/10*** | (2006.01) |
| ***H01R 33/08*** | (2006.01) |

(52) U.S. Cl. ..... 313/493; 313/318.02; 362/216; 362/260; 439/242; 439/617

(58) Field of Classification Search ..... 313/493, 313/264, 356, 318.01, 318.02, 318.03, 318.05, 313/318.06, 318.1, 51; 361/674; 362/216, 362/260; 315/209 R; 439/242–243, 619, 439/617, 229

See application file for complete search history.

(56) References Cited

U.S. PATENT DOCUMENTS

| | | | | |
|---|---|---|---|---|
| 4,283,217 | A * | 8/1981 | Kawamura | 65/108 |
| 4,319,162 | A * | 3/1982 | Hoeh | 313/487 |
| 4,458,301 | A | 7/1984 | Chapman et al. | |

(Continued)

FOREIGN PATENT DOCUMENTS

| | | |
|---|---|---|
| CN | 2134586 Y | 5/1996 |

(Continued)

*Primary Examiner*—Mariceli Santiago
*Assistant Examiner*—Anne M Hines
(74) *Attorney, Agent, or Firm*—Dowell & Dowell, P.C.

(57) ABSTRACT

An eccentric planar fluorescent tube includes an outer planar fluorescent tubular member that extends substantially but not completely about a center point and which is extended by two inner portions that extend from a first peripheral portion of the outer tubular member and on opposite sides of the center point and terminate at ends proximate to an opposite peripheral portion of the outer tubular member and wherein the ends are connected by a leg member for supplying power to the fluorescent tube. In one embodiment, the leg member includes electrical contacts that extend substantially in a plane of the outer tubular member and, in another embodiment, a central adapter may be provided including electrical contacts that extend transversely with respect to the plane of the outer tubular member.

7 Claims, 4 Drawing Sheets

U.S. PATENT DOCUMENTS 4,549,251 A * 10/1985 Chapman et al. ..... 362/216
5,471,375 A * 11/1995 Lau ..... 362/260
6,083,021 A 7/2000 Lau
6,531,824 B1 * 3/2003 Yan ..... 315/58
6,555,965 B1 * 4/2003 Oberle ..... 315/58
6,630,779 B1 * 10/2003 Tokes et al. ..... 313/493
6,726,496 B1 * 4/2004 Reich et al. ..... 439/227

FOREIGN PATENT DOCUMENTS

CN 1250222 A 4/2000
GB 2146755 A 4/1985

* cited by examiner

ECCENTRIC PLANAR FLUORESCENT TUBE

BACKGROUND OF THE INVENTION

1. Field of Invention

The invention relates to a plane-type fluorescent tube and more particularly, to an eccentric planar fluorescent tube.

2. Description of Related Art

Nowadays, the plane-type fluorescent lamps such as 2D, circular and polygonal fluorescent lamps are available popularly in the market with their tube typically in planar shape and leg member used as power supplying means located at the center of tube plane (e.g. 2D tube) or on the close periphery section of tube (e.g. circular and polygonal tubes).

The shortcomings of these plane-type fluorescent tubes are as follows.

1. Although they are used in ceiling mount, surface mount and recessed fixtures in general, they can not be used in center-pole configured fixture since they can not get through and attached to the center-pole due to their leg member arranged at the center of the tube plane or on the close periphery section of tube, and thus leads limitation in their applications.

2. Their luminous flux is lower since their total length is shorter and not compact enough.

SUMMARY OF INVENTION

The invention is directed to the problems described above, and intended to provide a novel eccentric planar fluorescent tube with more compact design, higher luminous flux and expanded application range.

According to an aspect of the invention, an eccentric planar fluorescent tube comprises a planar fluorescent tubular portion, two tube-ends for drawing out filaments, and a leg member provided at the tube-ends. Wherein on the basis of prior planar fluorescent tubes, said two tube-ends are extended from one periphery side of said tubular portion to another periphery side opposed to said one periphery side along a plane defined by said tubular segments at which the two tube-ends exist, so as to form two increased extended tubular segments, and a passage which passes a center of the tube plane in horizontal direction is formed at said periphery side and between said two extended tubular segments.

According to another aspect of the invention, one side of said leg member is held on the tube part in said another periphery side by a fixing member, other side of said leg member is engaged with two extended tube-ends, and power supplying pins connected to the filaments on two tube-ends are protruded from said leg member.

In the eccentric planar fluorescent tube (EPFT) resulted from above configuration, as compared to the prior planar fluorescent tube, the luminous flux is improved, and can be inserted into the center-pole configured lamp fixtures in radial direction to the center-pole, thus widening the application range.

BRIEF DESCRIPTION OF DRAWINGS

FIG. 3(*a*) shows a adapter member is added to the plane center of the EPFT. FIG. 3(*b*) shows a two part structure of the leg member.

DETAILED DESCRIPTION OF INVENTION

Figure 1A:
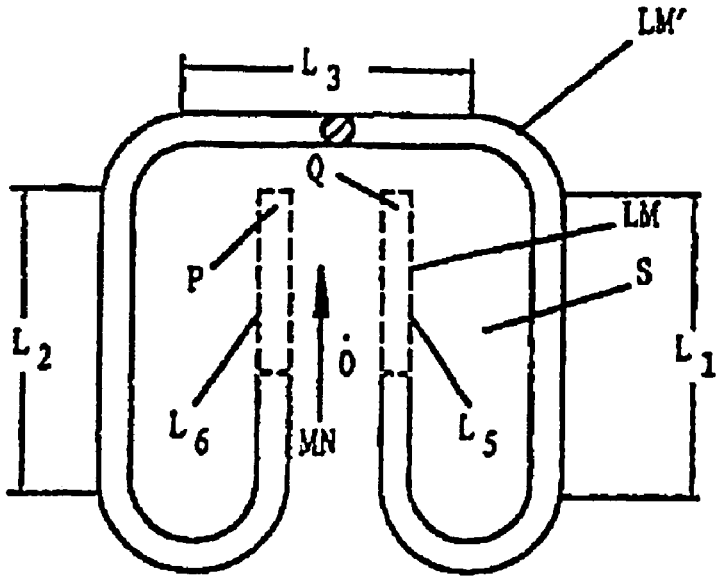
FIG. 1 is an exemplary view for comparing the tube section of EPFT in accordance with the invention to the configuration in prior art, wherein FIG. 1(*a*) shows a tube section of 2D tube, and FIG. 1(*b*) shows that of circular tube.
Figure 1B:
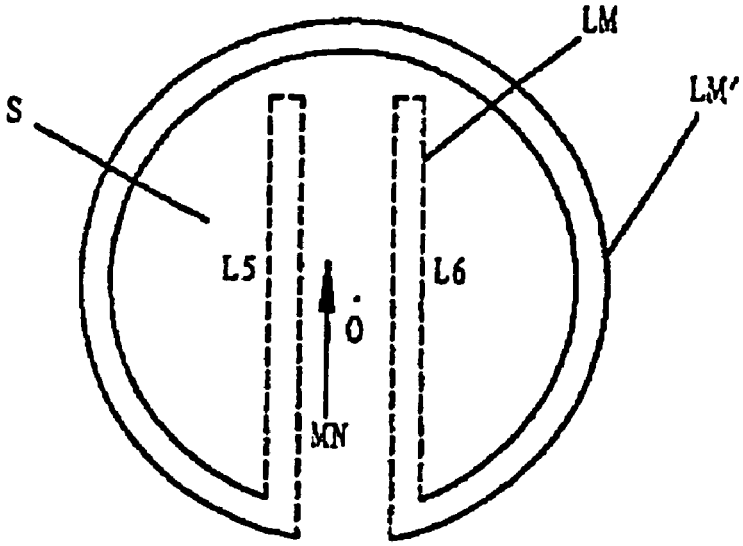

Referring to FIGS. 1(*a*) and 1(*b*), F1(*a*) shows a 2D tube, and FIG. 1(*b*) shows a circle tube. The tube section LM' of planar fluorescent tube (PFT) in prior art is indicated by solid line, while the tube section LM of EPFT (L) in accordance with the invention (see FIG. 2 for overall structure) is indicated by dotted line in addition to the solid line, as shown in FIGS. 1(*a*) and 1(*b*). As can be seen from FIGS. 1(*a*), 1(*b*) and FIG. 2, the EPFT (L) of the invention comprises a planar tube section LM, two tube-ends P and Q for drawing out filaments, and a leg member Y set between two tube-ends P and Q. The improved structure of EPFT (L) in accordance with the invention lies in that two tube-ends P and Q are extended based on the prior PFT, from one periphery side of tube section LM (lower side as shown in FIGS. 1(*a*) and 1(*b*)) to another periphery side opposed to said one periphery side (upper side as shown in FIGS. 1(*a*) and 1(*b*)) within the tube section LM surrounding plane S to obtain two additional extended tube parts L5 and L6 (the part of the dotted line plus solid line in FIG. 1(*a*) and the part of the dotted line in FIG. 1(*b*)) and from a passage MN capable of passing through the center O of tube plane from the horizontal direction thereof (as the arrow pointed shown in FIG. 1) among one periphery side (lower side as shown in FIG. 1) and two extended parts L5 and L6. Also a leg member Y to supply power for tube L is set between two tube ends P and Q. FIG. 1(*a*) and FIG. 1(*b*) shows the extended tube parts L5, L6 and periphery side of tube L1, L2 and LM' are in the same surface plane.

Figure 4A:
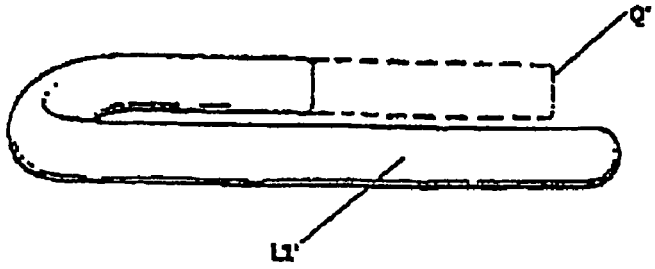
FIGS. 4(*a*)-(*c*) shows another shape of EPFT of the invention.
Figure 4B:
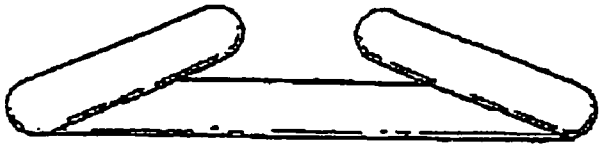
Figure 4C:
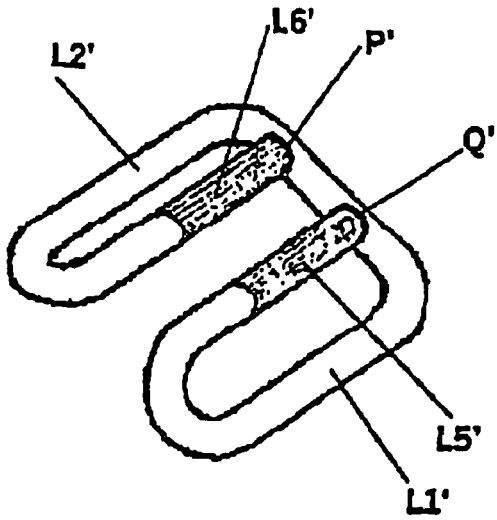

FIGS. 4(*a*)-(*c*) shows an example of another shape of EPFT of the invention. The difference of this invention between the invention from FIG. 1 is the surface plane formed by extended tube parts L5', L6' and the surface plane formed by periphery side of tube L1', L2' are not in the same plane but in two parallel planes. The rest of the structure of this invention is as same as the structure in FIG. 1(*a*).

The arrangement of a passage MN passing through the plane center O (i.e. the space of arrow location in FIG. 1(*a*) and FIG. 1(*b*)) allows the EPFT of the invention to lay at a centrally symmetric location of a center-pole fixture, increases the tube length together with increase of the luminous flux, as described below.

Figure 2:
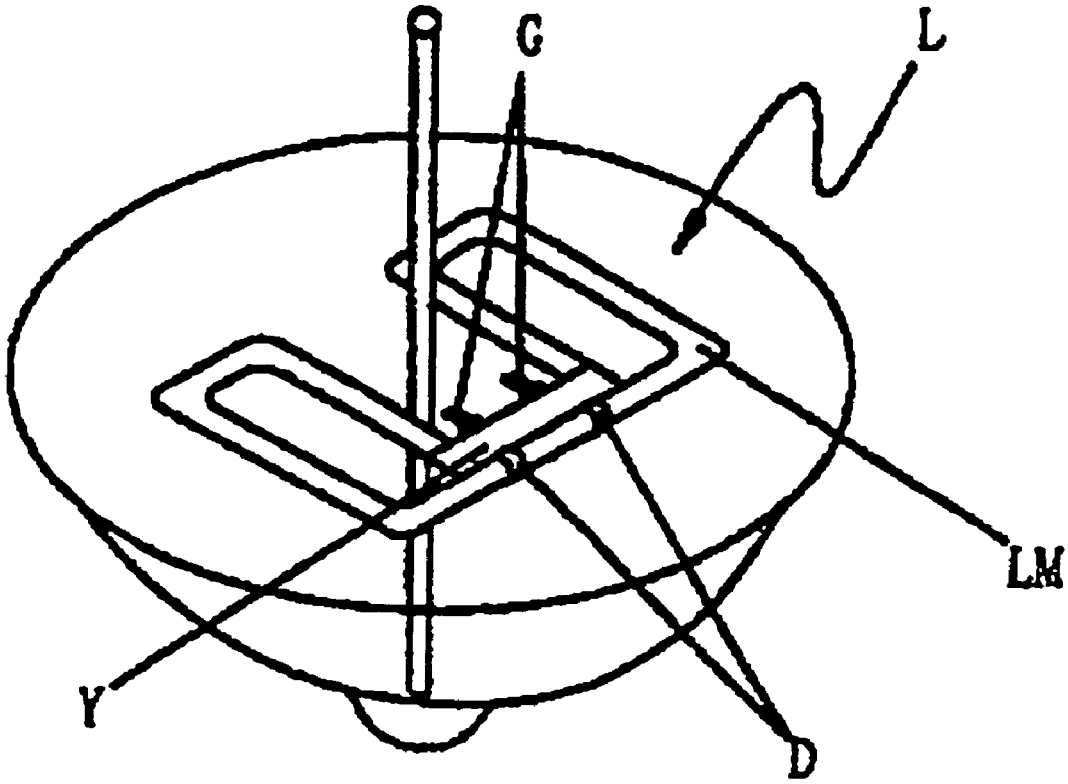
FIG. 2 is a conceptual view showing an EPFT (2D) of the invention arranged with a center-pole configured fixture.

Referring to FIG. 2, a conceptual view of the 2D EPFT (L) in accordance with the invention is shown. In FIG. 2, one side of leg member Y in tube L is held on the tubular portion in another periphery side (i.e. upper tube part in FIGS. 1(*a*) and 1(*b*)) by a fixing member D, other side of leg member Y is engaged with two extended tube-ends P and Q, and power supplying pins G connected to the filaments (not shown) on two tube-ends P and Q are protruded from the leg member Y. For circle EPFT, the structure of leg member and its location related to the tube section are similar to these in 2D tube described above, so their description and illustration are omitted.

The detailed improvements listed above are also applicable to other polygonal planar fluorescent tubes and therefore their detailed description and illustration are also omitted.

As seen from FIG. 2, the EPFT of the invention can be inserted into a center-pole fixture from side (i.e. horizontal direction of tube plane) since a passage MN passing through the plane center O is available. On the other hand, for the PFT in prior art, the leg member (not shown) is located at the center of tube plane or on the close periphery section of tube, so it cannot be inserted into a center-pole fixture from side, or even the tube can be partially inserted in such case as 2D tube, the center-pole can not be located at the center O of the plane surrounded by periphery section of fluorescent tube, and thus its application is limited.

FIG. 2 shows an example of leg member located at another periphery side of the tube of the EPFT of the invention.

Figure 3A:
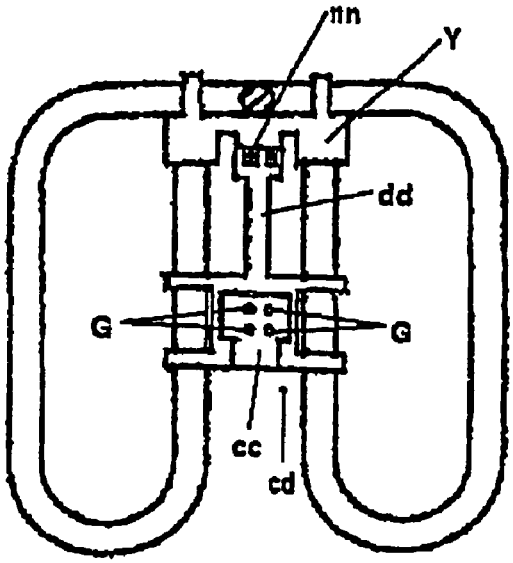
FIG. 3 shows practical examples of the leg member structures of EPFT of the invention.
Figure 3B:
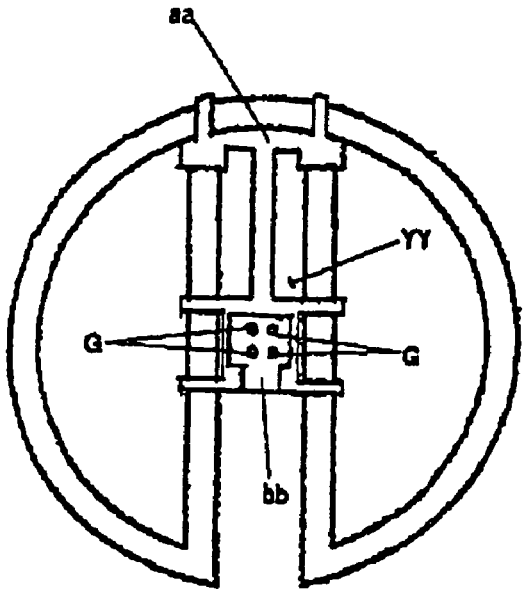

FIG. 3(*a*) shows an example of supplying power to the lamp at center of the EPFT of the invention by means of a adapter member; FIG. 3(*b*) shows an example of the leg member located in the center of the EPFT of the invention.

In order to use EPFT of the invention to replace the prior PFT, the inventor designed the practical structures of the adapter member and leg member in FIG. 3(*a*) and FIG. 3(*b*) to realize supplying the power to the center of the EPFT of the invention.

Referring to FIG. 3(*a*), the said EPFT also comprises an adapter body (cc) and adapter arm (dd) to form a adapter member (cd). The adapter body (cc) is located in the center part of the tubular portion with two extended tube parts (L5, L6). The adapter arm (dd) is extended from adapter body (cc) to leg member (Y) (see FIG. 2) and an electrical connection is formed between power supplying pins (G) of leg member (Y) and power supplying pins (G) of adapter body (cc) (see FIG. 2) through connector (nn) which is located at the end of adapter arm and is electrically connected to the power supplying pins (G) of adapter body (cc) (see FIG. 2).

Referring to FIG. 3(*b*), the said leg member of the EPFT (YY) comprises two part (aa, bb). Part (aa) is installed at the said another periphery side of the tube (upper side as show in FIG. 1(*a*) and FIG. 1(*b*)) and held on two tube-end (P, Q). Part (bb) is installed in the center part of the tubular portion with two extended tube parts (L5, L6) and power supplying pins (G) electrically connected to filaments from two tube-ends (P, Q) are located in part (bb) of the leg member (YY).

Two part (aa) and (bb) may be made as one part.

The orientation and number of the power supplying pins (G) is not fixed and will be changed by different application.

Furthermore, in case of supplying same input power (i.e. with same wattage) to the lamp with same outline size, the EPFT of the invention provides both higher lumen efficacy and higher luminous flux than that in prior art due to the increase of the effective tube length. To clarify, an example of 2D EPFT will be given in below.

Referring to the solid line portion in FIG. 1(*a*), for a planar fluorescent tube section of standard 55W 2D lamp (also known as twin D), the length of its straight parts L1=L2=L3 are 110 mm respectively, two inner straight parts are 50 mm respectively, and the radius of curve parts R=36 mm, therefore, the total length of raw tube=3×110 mm+1.5×2 pi×(36 mm+2)×50 mm≈860 mm.

For the EPFT of the invention, referring to the dotted line portion in addition to the solid line portion in FIG. 1(*a*), its total length of raw tube is longer than that in prior art described above by adding 2 dotted line portions of tube. If the distance between the end and the straight part L3 perpendicular to tube parts L5 and L6 is 8 mm, then the length of a dotted line portion of tube will be 75 mm, and the total length of raw tube in accordance with the invention will be 860 mm+2×75 mm≈1010 mm. Namely, the effective electrical discharging length is longer than that of the solid line portion in prior art by about 17%. Accordingly, the luminous flux increases about 17% than that of prior art under the same operation current (in the order of 770 mA for 55 W tube).

In above section, the detailed description of the invention has been given in connection with embodiments. Among them, the key point of the invention is the formation of a passage passing through the center by two extended inner tube parts opposed to each other so that a leg member can be set eccentrically. For other structures, no particular restriction is made. For example, normal power of the tube, pin numbers in leg member, direction of pins, 8 mm distance described above, and the likes may be determined based on other requirements for use.

The examples and description given above are merely used for the purpose of understanding the invention and should not be limited to the related specific parameters and the details in structure as shown, but only be limited by the appended claims.

The invention claimed is:

1. An eccentric fluorescent tube comprising; an outer tubular portion that extends in a first plane substantially about a center point and from which extend two inner portions that are spaced on opposite sides of the center point and within the outer tubular portion, said two inner tubular portions extending from a first peripheral side of said outer tubular portion to ends that are positioned proximate an opposing second peripheral side of said outer tubular portion, a leg member connected between said ends of said inner tubular portions for supplying power to said outer portion and said two inner tubular portions, an adapter member having an adapter body mounted at the center point to said two inner tubular portions, said adapter body having power supply pins adapted to be selectively connected to a source of electrical power supply, and said adapter member including an adapter arm extending from said adapter body and communicating with said leg member through which power is supplied from said power supply pins through said adapter body, said adapter arm and said leg member to said outer tubular portion and said two inner tubular portions.

2. The eccentric fluorescent tube set forth in claim 1, wherein said leg member is mounted on a tubular segment of said outer tubular portion located at said opposing second periphery side by a fixing member, and additional power supply pins protruding from said leg member which are electrically connected to filaments at both of said ends of said two inner tubular portions.

3. The eccentric fluorescent tube set forth in claim 1, wherein said leg member is mounted to said opposing second periphery side of said outer tubular portion and said adapter member and said leg member being integrally formed with one another.

4. The eccentric fluorescent tube set forth in claim 2 wherein said adapter arm extended from said adapter body is electrically connected to said additional power supply pins of said leg member such that said power supply pins of said adapter body are electrically connected to said additional power supply pins of said leg member.

5. The eccentric fluorescent tube set forth in claim 1 wherein said two inner tubular portions are disposed in a second plane that is different than said first plane of said outer tubular portion.

6. The eccentric fluorescent tube set forth in claim 1 wherein said outer tubular portion and said two inner tubular portions are co-planar.

7. The eccentric fluorescent tube set forth in claim 1 wherein said two inner tubular portions are generally parallel with respect to one another.

* * * * *